United States Patent [19]

Henderson

[11] 3,958,201

[45] May 18, 1976

[54] INTERLACED DISC COIL WINDING HAVING OFFSET CROSS-CONNECTIONS

[75] Inventor: Mahlon L. Henderson, Campinas, Brazil

[73] Assignee: General Electric Company

[22] Filed: Nov. 29, 1974

[21] Appl. No.: 527,960

[52] U.S. Cl. ..... 336/70

[51] Int. Cl.[2] ..... H01F 15/14

[58] Field of Search ..... 336/69, 70, 186, 187; 310/213; 174/33, 34, 114

[56] References Cited

UNITED STATES PATENTS

| | | | |
|---|---|---|---|
| 2,436,188 | 2/1948 | Bilodeau | 336/187 X |
| 2,453,552 | 11/1948 | Stearn | 336/70 X |
| 3,479,629 | 11/1969 | Broszat | 336/70 |
| 3,781,739 | 12/1973 | Meyer | 336/70 |

FOREIGN PATENTS OR APPLICATIONS

| | | | |
|---|---|---|---|
| 444,804 | 1/1967 | Japan | 336/70 |
| 1,365,286 | 5/1964 | France | 336/187 |
| 4,619,447 | 7/1968 | Japan | 336/70 |

*Primary Examiner*—Thomas J. Kozma
*Attorney, Agent, or Firm*—J. J. Kelleher

[57] ABSTRACT

Cross-connections in cross-connection regions of adjacent winding sections of a disc-wound interlaced winding are physically offset from each other circumferentially of the winding or in the direction in which the conductor turns of a winding are wound. This physical offset increases the physical separation of otherwise adjacent conductor turns in adjacent winding sections at the inner surface of the winding, which are usually separated electrically by several series turns, thereby reducing the axial voltage gradient between such conductor turns.

6 Claims, 16 Drawing Figures

Fig. 1.
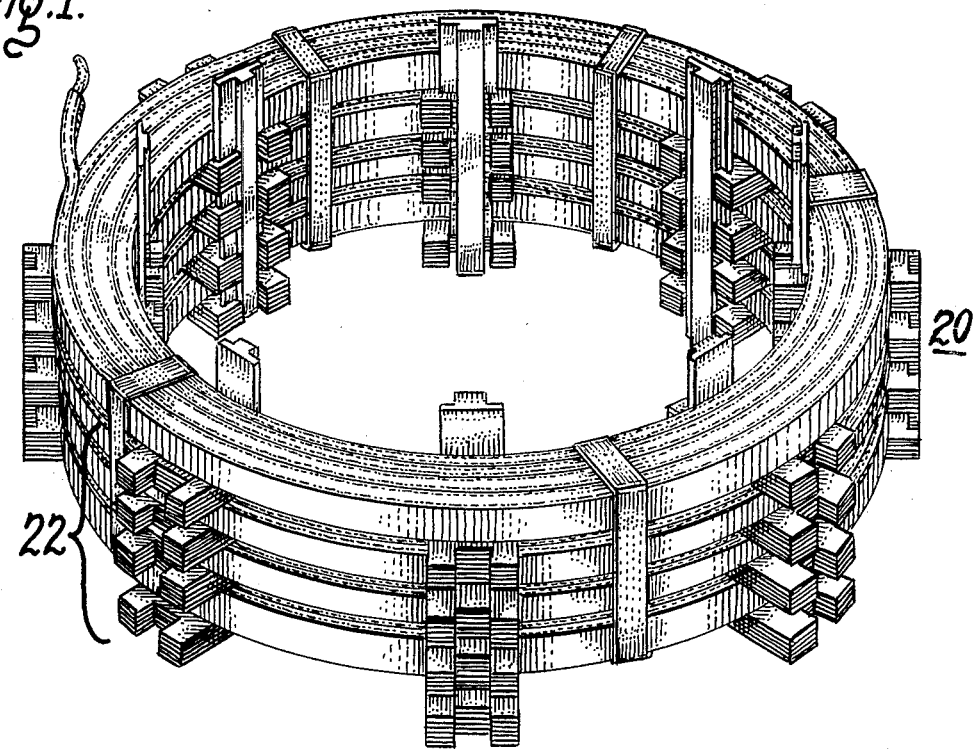
Fig. 2.
PRIOR ART
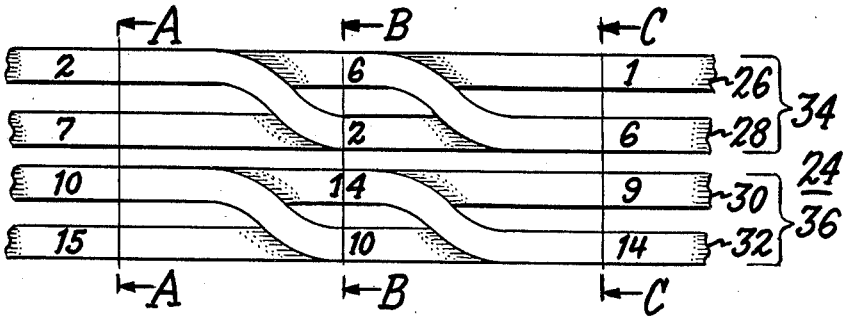
Fig. 2A.
PRIOR ART
| | | | |
|---|---|---|---|
| 2 | 6 | 1 | 5 |
| 7 | 3 | 8 | 4 |
| 10 | 14 | 9 | 13 |
| 15 | 11 | 16 | 12 |
Fig. 2B.
PRIOR ART
| | | | |
|---|---|---|---|
| 6 | 1 | 5 | 0 |
| 2 | 7 | 3 | 4 |
| 14 | 9 | 13 | 8 |
| 10 | 15 | 11 | 12 |
Fig. 2C.
PRIOR ART
| | | | |
|---|---|---|---|
| 1 | 5 | 0 | 4 |
| 6 | 2 | 7 | 3 |
| 9 | 13 | 8 | 12 |
| 14 | 10 | 15 | 11 |

Fig. 3.
NEW
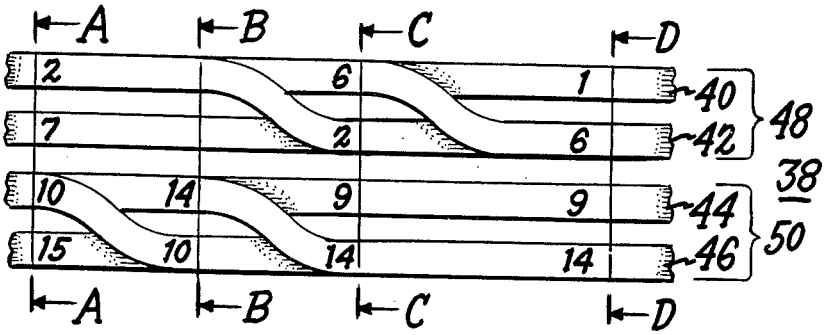
Fig. 3A.
| | | | |
|---|---|---|---|
| 2 | 6 | 1 | 5 |
| 7 | 3 | 8 | 4 |
| 10 | 14 | 9 | 13 |
| 15 | 11 | 16 | 12 |
Fig. 3B.
| | | | |
|---|---|---|---|
| 2 | 6 | 1 | 5 |
| 7 | 3 | 8 | 4 |
| 14 | 9 | 13 | |
| 10 | 15 | 11 | 12 |
Fig. 3C.
| | | | |
|---|---|---|---|
| 6 | 1 | 5 | 0 |
| 2 | 7 | 3 | 4 |
| 9 | 13 | 8 | 12 |
| 14 | 10 | 15 | 11 |
Fig. 3D.
| | | | |
|---|---|---|---|
| 1 | 5 | 0 | 4 |
| 6 | 2 | 7 | 3 |
| 9 | 13 | 8 | 12 |
| 14 | 10 | 15 | 11 |
Fig. 4.
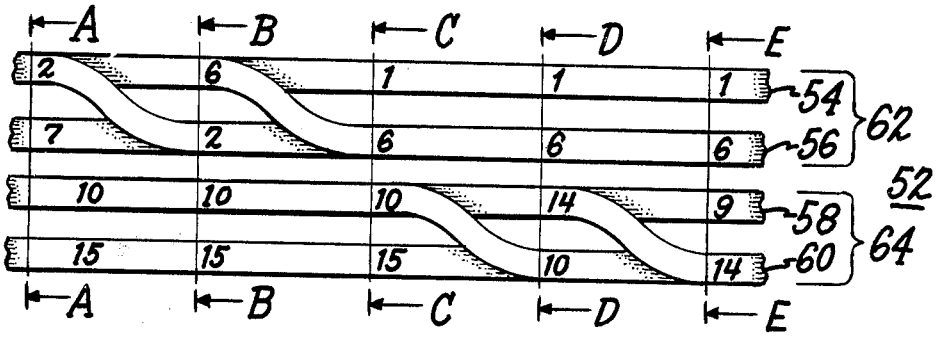
Fig. 4A.
| | | | |
|---|---|---|---|
| 2 | 6 | 1 | 5 |
| 7 | 3 | 8 | 4 |
| 10 | 14 | 9 | 13 |
| 15 | 11 | 16 | 12 |
Fig. 4B.
| | | | | |
|---|---|---|---|---|
| 6 | 1 | 5 | 0 | |
| 2 | 7 | 3 | 8 | 4 |
| 10 | 14 | 9 | 13 | |
| 15 | 11 | 16 | 12 | |
Fig. 4C.
| | | | |
|---|---|---|---|
| 1 | 5 | 0 | 4 |
| 6 | 2 | 7 | 3 |
| 10 | 14 | 9 | 13 |
| 15 | 11 | 16 | 12 |
Fig. 4D.
| | | | | |
|---|---|---|---|---|
| 1 | 5 | 0 | 4 | |
| 6 | 2 | 7 | 3 | |
| 14 | 9 | 13 | 8 | |
| 10 | 15 | 11 | 16 | 12 |
Fig. 4E.
| | | | | |
|---|---|---|---|---|
| 1 | 5 | 0 | 4 | |
| 6 | 2 | 7 | 3 | |
| 9 | 13 | 8 | 12 | |
| 14 | 10 | 15 | 11 | 16 |

INTERLACED DISC COIL WINDING HAVING OFFSET CROSS-CONNECTIONS

BACKGROUND OF THE INVENTION

The present invention relates generally to windings for electric induction apparatus and particularly to winding arrangements for disc-wound interlaced windings that will significantly reduce the axial voltage gradient and therefore the electrical insulation required between particular conductor turns at the inner surface of such windings, where the combination of axial voltage gradient and radial voltage gradient to an adjacent inner winding or ground, causes an increased resultant voltage gradient.

It is well known that highly inductive windings such as iron core transformer and reactor windings, when exposed to steep wave front impulse or transient voltages, initially exhibit an exponential distribution of voltage drop along the length of the winding with a very high voltage gradient appearing at the first few turns adjacent the high voltage end. This condition arises because such windings present a predominantly capacitive impedance to steep impulse voltages. Such capacitive impedance is made up of a complex network of capacitances in a series and parallel relation. If series capacitance only were present, voltage distribution throughout the winding would be substantially uniform and linear. The larger the series capacitance with respect to the parallel or ground capacitance of such windings, the more uniform the initial distribution of steep wave transient or impulse voltages applied to such windings.

One common type of high voltage winding for transformers and reactors is the so-called disc winding wherein each of a plurality of annular coils is wound on a core as a radial spiral, the coils being disposed co-axially on the core and connected electrically in a series circuit relation. In such a disc winding it is known that series capacitance may be increased and impulse voltage distribution improved by constructing the winding in groups of coils called winding sections, with each winding section having at least two coils, the coils of a winding section being connected together in a re-entrant series interlaced relation, as illustrated in U.S. Pat. No. 2,453,552 to STEARN.

Cross-connections between the disc coils of a winding section usually occur in well-defined cross-connection regions that are generally aligned with each other and with the longitudinal axis of a winding. These cross-connection regions extend a limited distance circumferentially of the winding. Due to the nature of an interlaced winding, a conductor at the internal surface of such a winding providing the cross-connections between the disc-wound coils of a winding section is separated from a corresponding internal conductor in an adjacent winding section by only the normal spacing between disc-wound coils. The just-mentioned cross-connection conductor in one winding section and the corresponding internal conductor in an adjacent winding section are connected together in the winding through several conductor turns which creates a substantial voltage gradient between these internal conductors in adjacent cross-connection regions. This voltage gradient and therefore the electrical stress between these conductors is normally compensated for by either increasing the insulation of the affected conductors in the cross-connection region or by increasing the axial separation of the affected disc coils. However, these insulation increasing modifications necessarily result in an increase in the physical dimensions of the winding with attendant weight and cost penalties. In addition, the just-mentioned insulation increasing modifications result in a winding having an irregular surface, requiring greater physical separation between windings in a multiple winding inductive device or between a winding and the core of an inductive device.

Furthermore, a winding design that aligns all of the cross-connections of a winding section with each other and with the longitudinal axis of the winding produces a winding design having less than desirable locations for winding taps and connections.

Additionally, in prior art windings at the interlaced disc-wound type having cross-connections aligned, the mechanical process of bending the conductors from one coil to another and adding some small insulation for mechanical protection, results in a "bulge" or overbuild in the radial dimension of the coil in the cross connection region.

Accordingly, it is the principal object of the present invention to provide an interlaced disc winding that will avoid the necessity of providing additional insulation between particular conductors at the inner surface of such a winding.

Another object of the present invention is to provide an interlaced disc winding that will have physical dimensions of minimal size with attendant weight and cost savings.

Still another object of the present invention is to provide an interlaced disc winding that will have a regular exterior surface.

A further object of the present invention is to provide an interlaced disc winding that will have desirable locations on the winding for taps and connections thereto.

SUMMARY OF THE INVENTION

Disc-wound coils of an interlaced winding are wound in groups called winding sections, with each group containing at least two coils. Cross-connections between the coils of a winding section usually occur in a well defined cross-connection region that extends a limited distance circumferentially of the winding. Cross-connections in the cross-connection regions of adjacent winding sections, in accordance with the present invention, are physically offset from each other circumferentially of the winding. This physical offset increases the separation of otherwise adjacent conductor turns that are separated electrically by several turns thereby significantly reducing the axial voltage gradient between such turns.

The invention, which is sought to be protected, will be particularly pointed out and distinctly claimed in the claims appended thereto. However, it is believed that this invention and the manner in which its objects and advantages are obtained, as well as other objects and advantages thereof, will be more readily understood by reference to the following detailed description of the preferred embodiments thereof particularly when considered in light of the accompanying drawings.

BRIEF DESCRIPTION OF THE DRAWINGS

FIG. 1 is a perspective view of an interlaced winding, having four disc-wound coils, of the type described in the present invention.

FIG. 2 is a fragmented inside elevation of an interlaced winding of the type depicted in FIG. 1, showing the non-offset cross-connection winding construction of the prior art.

FIGS. 2A, 2B and 2C are sectional views taken along the lines A—A, B—B and C—C in FIG. 2, respectively.

FIG. 3 is a fragmented inside elevation of an interlaced disc winding of the type depicted in FIG. 1, showing the "step-back" coil winding arrangement of the present invention.

FIGS. 3A, 3B, 3C and 3D are sectional views taken along the lines A—A, B—B, C—C and D—D in FIG. 3, respectively.

FIG. 4 is a fragmented inside elevation of an interlaced disc winding of the type depicted in FIG. 1, showing the "step-forward" winding arrangement of the present invention.

FIGS. 4A, 4B, 4C, 4D and 4E are sectional views taken along the lines A—A, B—B, C—C, D—D and E—E in FIG. 4, respectively.

DESCRIPTION OF THE PRIOR ART

Referring now to the drawings wherein like numerals are used to indicate like parts throughout, in FIG. 1 a perspective view of an interlaced winding having four disc-wound coils, of the type to be described in the preferred embodiment and in this description of the prior art, is depicted. Winding 20 has four spirally wound disc coils spirally wound together in a reentrant series interlaced relation (interlacing not shown), axially aligned and in a spaced relation. Groups of spacers, such as spacer group 22, maintain the disc coils of winding 20 in the just-mentioned spaced relation.

Referring at this point to FIG. 2 which is a fragmented inside elevation of a prior art interlaced disc winding 24, of the type illustrated in FIG. 1, winding 24 has, from top to bottom, spirally wound disc coils 26, 28, 30 and 32 axially aligned in a spaced relation. Coils 26 and 28 form winding section 34 and coils 30 and 32 form winding section 36. Reference should also here be made to FIGS. 2A, 2B and 2C which are sectional views taken along the lines A—A, B—B and C—C in FIG. 2. As can be seen by referring to FIGS. 2, 2A–2C, winding section 34 of winding 24 is formed by making two full spiral turns in coils 26, cross-connecting coil 26 to coil 28, making two full spiral turns in coil 28, cross-connecting coil 28 back to coil 26 for two additional full spiral turns in coil 26 and then cross-connecting coil 26 back to coil 28 for two additional full spiral turns in coil 28 thereby completing the number of turns required in winding section 34. After completing winding section 34, coil 28 is then cross-connected to coil 30 in winding section 36. Winding section 36 is then wound in the same manner as winding section 34. That is to say, two full spiral turns are first formed in coil 30. A cross-connection is made to coil 32 followed by two full spiral turns in coil 32. A cross-connection is then made back to coil 30 for two additional full spiral turns in coil 30 and then a cross-connection is made back to coil 32 for the final two full spiral turns in coil 32 thereby completing the number of turns required in coil 32, winding section 36 and winding 24.

By referring to FIG. 2, it can be seen that all of the cross-connections internal of winding section 34 and internal of winding section 36 fall within fairly well-defined regions extending a limited distance circumferentially of said winding sections 34 and 36, said regions being aligned with each other and with the longitudinal central axis of winding 24. In this prior art winding 24, it can be seen, by referring to FIG. 2, that turn 2 in coil 28 of winding section 34 is adjacent turn 14 in coil 30 of winding section 36 and that these turns are separated electrically by twelve turns (turn 14 minus turn 2), which is equivalent to the turns of three coils (four turns per coil). This just mentioned 12-turn difference creates a voltage gradient between said turn 2 and turn 14, which are inner surface turns on winding 24, that is significantly greater than the voltage gradient between other inner surface turns of said winding 24. This increased voltage gradient requires increased insulation in this high voltage gradient region. This is normally accomplished by either adding additional insulation to the winding in this high voltage gradient region or by increasing the axial separation between the winding sections having such a high voltage gradient between them.

DESCRIPTION OF THE PREFERRED EMBODIMENTS

First Embodiment

Turning now to the present invention and to FIG. 3, which is a fragmented inside elevation of an interlaced disc winding having four spirally-wound disc coils, incorporating the winding arrangement of the present invention. Winding 38 has, from top to bottom, disc coils 40, 42, 44 and 46 axially aligned in a spaced relation. Coils 40 and 42 form winding section 48 and coils 44 and 46 form winding section 50. Reference should additionally be made to FIGS. 3A, 3B, 3C and 3D which are sectional views taken along the lines A—A, B—B, C—C and D—D in FIG. 3. As can be seen by referring to FIGS. 3, 3A–3D, winding section 48 is formed by making two full spiral turns in coil 40, cross-connecting coil 40 to coil 42, making two full spiral turns in coil 42, cross-connecting coil 42 back to coil 40 for two additional full spiral turns in coil 40 and then cross-connecting coil 40 back to coil 42 for two additional full spiral turns in coil 42, thereby completing the number of turns required in winding section 48. After completing winding section 48, coil 42 is then cross-connected to coil 44 in winding section 50. Winding section 50 is formed by making one full and then one partial spiral turn in coil 44, cross-connecting coil 44 to coil 46, making two full spiral turns in coil 46, cross-connecting coil 46 back to coil 44 for two full spiral turns in coil 44 and then cross-connecting coil 44 back to coil 46 for two additional full spiral turns in coil 46, thereby completing the number of turns required in winding section 50 and at the same time completing the number of turns required in winding 38. As can be seen by referring to FIGS. 3, 3B, and 3C turn 14 at the inside surface of coil 44 in the cross-connection region of winding section 50, is physically stepped-back or offset from turn 2 at the inside surface of coil 42 in winding section 48. This just-mentioned step-back of turn 14 from turn 2 in winding 38 increases the physical separation and reduces the voltage gradient between said turns 14 and 2.

Second Embodiment

Instead of reducing the voltage gradient between certain inner surface conductor turns of adjacent winding sections by stepping-back the cross-connections of adjacent winding sections, such a voltage gradient reduction may also be achieved by a step-forward type offset arrangement. The major difference between step-back and step-forward types of offset arrangements is that in the former there is a partial turn reduction, while in the latter there is a partial turn addition from or to the winding.

Turning now to FIG. 4 which is a fragmented inside elevation of an interlaced winding having four spirally wound disc coils, showing the step-forward winding arrangement of the second embodiment of the present invention. Winding 52 has, from top to bottom, disc coils 54, 56, 58 and 60 axially aligned in a spaced relation. Coils 54 and 56 form winding section 62 and coils 58 and 60 form winding section 64. Reference should additionally be made to FIGS. 4A, 4B, 4C, 4D and 4E which are sectional views taken along the lines A—A, B—B, C—C, D—D and E—E in FIG. 4. As can be seen by referring to FIGS. 4, 4A–4E, winding section 62 of winding 52 is formed by making two full spiral turns in coil 54, cross-connecting coil 54 to coil 56, making two full spiral turns in coil 56, cross-connecting coil 56 back to coil 54 for two additional full spiral turns in coil 54 and then cross-connecting coil 54 back to coil 56 for two additional full spiral turns in coil 56 thereby completing the number of turns required in winding section 62. After completing winding section 62, coil 56 is then cross-connected to coil 58 in winding section 64. One full spiral turn and then a spiral turn greater than one full turn is formed in coil 58. A cross-connection is made to coil 60 followed by two full spiral turns in coil 60. A cross-connection is then made back to coil 58 for two additional full spiral turns in coil 58 and then a cross-connection is made back to coil 60 for the final two full spiral turns in said coil 60, thereby completing the number of turns required in coil 60, winding section 64 and winding 52.

By referring to FIG. 4, 4A–4E, it can be seen that the cross-connections of winding section 64 are physically stepped-forward from the cross-connections of winding section 62 thereby increasing the physical separation between turn 2 in winding section 62 and turn 14 in winding section 64, thereby significantly reducing the voltage gradient between said turns 2 and 14 from what it would be if the cross-connections in winding sections 62 and 64 were not offset.

DISCUSSION

It should be noted that in the step-back type of offset arrangement depicted in FIGS. 3, 3A–3D, the greatest difference between inner surface turns of adjacent winding sections in winding 38 is seven turns. By comparison, the difference between inner turns of adjacent winding sections in prior art winding 24 is twelve turns. By comparing these two types of winding arrangements it can be seen that the step-back type of offset arrangement reduces the voltage gradient between inner turns of adjacent winding sections by more than one-third from that present between corresponding turns in prior art windings of the type depicted in FIGS. 2, 2A–2C.

In the step-forward type of offset arrangement as depicted in FIGS. 4, 4A–4E, voltage gradient reduction between inner surface turns of adjacent winding sections is slightly less effective than the step-back type of offset arrangement. The greatest difference between such turns in the step-forward type of offset arrangement is eight turns which result in a voltage gradient reduction of exactly one-third over the prior art type of winding arrangement depicted in FIGS. 2, 2A–2C.

The step-back type of winding arrangement results in a turn reduction in a winding whereas the step-forward type of winding arrangement results in a turn addition. If the number of turns required for a particular winding is critical, a turn may be added or subtracted, as the need arises, at the end of such a winding.

The description in the preferred embodiments and the drawings referenced therein show a particular interlaced winding incorporating the present invention, having a single conductor and an even number of turns per coil which is effective in reducing the axial voltage gradient between inner surface conductors of such a winding. However, the present invention is not limited to the arrangements so described in the preferred embodiments. The present invention is also effective in reducing the axial voltage gradient between inner conductors of interlaced windings having conductors in multiple and/or having an odd number of turns per coil. The arrangement of turns and the amount of offset required in such windings depends upon the number of turns per coil and number of strands per turn. However, the general concept of offsetting cross-connections in adjacent winding sections in such windings is still applicable. It should be noted that in such windings the cross-connection regions will have to be physically larger in the direction of the winding turns than the windings described in the preferred embodiments.

While in the practice of this invention it is to be recognized that the reduction of axial voltage gradients between adjacent winding sections is effective at any part of a winding, it is usually more important to do this near the line connection where both radial and axial gradients are generally higher. All or any part of a winding may be made using this invention.

It is to be understood that all of the coils of a particular winding of the type described herein are wound in the same direction around the central axis of the particular winding.

The word "substantial" is used herein to describe the degree to which cross-connections in adjacent winding sections, of windings constructed in accordance with the present invention, are offset from each other. In this context, substantial offset means offset in excess of the normal offset that is present in windings of the type described herein other than offset inherent in the manufacture of such coils. The amount of offset required between adjacent cross-connections of adjacent winding sections is directly related to the voltage to which the windings described herein are subjected.

The term "central winding axis" used herein means the axis that is perpendicular to the various parallel plans in which the disc coils of a winding are located and is coincident with each individual coil axis around which each individual disc coil of said winding is wound.

It will be apparent to those skilled in the art from the foregoing descriptions of the present invention that various improvements and modifications can be made in it without departing from the true scope of the invention. Accordingly, it is my intention to encompass within the scope of the appended claims the true limits and spirit of my invention.

I claim:

1. In an inductive winding for electrical apparatus of the type having a plurality of coaxially disposed disc-wound annular coils, said coils being arranged into at least two serially connected winding sections, each winding section having at least two of said disc-wound annular coils spirally wound together in a re-entrant series interlaced relation, cross-connections between coils in a winding section being made in a region adjacent the coils of said winding section extending a limited distance circumferentially of the winding, the improvement comprising:

that a cross-connection at the internal surface of a winding section is offset circumferentially of said inductive winding a substantial distance from a cross-connection at the internal surface of an adjacent winding section.

2. An inductive winding for electrical apparatus as defined in claim 1 wherein adjacent offset cross-connections are of the step-back type.

3. An inductive winding for electrical apparatus as defined in claim 1 wherein adjacent offset cross-connections are of the step-forward type.

4. An inductive winding for electrical apparatus as defined in claim 1 wherein each disc-wound annular coil has an even number of turns.

5. An inductive winding for electrical apparatus as defined in claim 1 wherein each disc-wound annular coil has an odd number of turns.

6. An inductive winding for electrical apparatus as defined in claim 1 wherein each disc-wound annular coil is of the type having a plurality of parallel conductor turns.

* * * * *